US007271680B2

(12) United States Patent
Hall et al.

(10) Patent No.: US 7,271,680 B2
(45) Date of Patent: Sep. 18, 2007

(54) METHOD, APPARATUS, AND SYSTEM FOR PARALLEL PLATE MODE RADIAL PATTERN SIGNALING

(75) Inventors: Stephen Hall, Hillsborough, CA (US); Tao Liang, Westford, MA (US); Howard Heck, Hillsboro, OR (US); Bryce Horine, Aloha, OR (US); Gary Brist, Yamhill, OR (US)

(73) Assignee: Intel Corporation, Santa Clara, CA (US)

( * ) Notice: Subject to any disclaimer, the term of this patent is extended or adjusted under 35 U.S.C. 154(b) by 21 days.

(21) Appl. No.: 11/172,572

(22) Filed: Jun. 29, 2005

(65) Prior Publication Data

US 2007/0001907 A1 Jan. 4, 2007

(51) Int. Cl.
*H01P 5/02* (2006.01)

(52) U.S. Cl. ..... 333/24 R; 333/136; 333/248

(58) Field of Classification Search ..... 333/24 R, 333/239, 248, 125, 136, 137
See application file for complete search history.

(56) References Cited

U.S. PATENT DOCUMENTS

| | | | | |
|---|---|---|---|---|
| 4,684,874 | A * | 8/1987 | Swift et al. | 333/125 |
| 4,700,145 | A * | 10/1987 | Yelland et al. | 330/286 |
| 4,933,651 | A * | 6/1990 | Benahim et al. | 333/125 |
| 5,982,256 | A * | 11/1999 | Uchimura et al. | 333/239 |
| 6,242,984 | B1 * | 6/2001 | Stones et al. | 330/295 |
| 6,882,239 | B2 * | 4/2005 | Miller | 333/24 R |
| 6,960,970 | B2 * | 11/2005 | Elco | 333/239 |
| 7,088,199 | B2 * | 8/2006 | Bartley et al. | 333/24 R |
| 2006/0284701 | A1 * | 12/2006 | Wu et al. | 333/125 |

* cited by examiner

*Primary Examiner*—Benny Lee
(74) *Attorney, Agent, or Firm*—Cyndi M. Wheeler

(57) ABSTRACT

A method, system, and apparatus for high data rate parallel plate mode signaling.

18 Claims, 4 Drawing Sheets

METHOD, APPARATUS, AND SYSTEM FOR PARALLEL PLATE MODE RADIAL PATTERN SIGNALING

BACKGROUND

The present invention relates to high speed signaling for multi-drop or point-to-point buses and more specifically to a wireless alternative for sending high speed signals between components on a printed circuit board (PCB) or multi-chip module (MCM).

As data rates in computer systems continue to increase, traditional multi-drop buses such as the front side bus (FSB) used in Intel® Pentium 4™ systems begin to severely limit system speed. For example, the multi-drop FSB used in current Pentium 4 systems will not support data rates faster than approximately 800 gigabits per second.

Traditional multi-drop buses include stubs, or taps required to attach the multiple loads. These stubs cause impedance discontinuities, induce reflections, and can severely degrade the signal integrity.

FIG. 1 illustrates the topology of a traditional routed multi-drop FSB, where agents 102, 104, and 106 are processors within a multi-processor system and device 108 is a chipset, such as a North Bridge. The impedance of the channel (110), $Z_{channel}$ is 50Ω and the impedance of a stub (112), $Z_{stub}$ is 50Ω. If agent 102 is driving, 33% of the energy is reflected at the first stub 112, which connects agent 104 to the main channel:

$$Z_{in}=Z_{channel}\|Z_{stub}=25\ \Omega$$

$$\Gamma_{stub}=[Z_{in}-Z_{stub}]/[Z_{in}+Z_{stub}]=-1/3$$

Subsequently, only ⅔ of the signal is transmitted to agent 106, which will have the same reflection coefficient as seen at agent 104. Additionally, the reflected signal will bounce back and forth on the bus, dramatically degrading the signal integrity.

Although some techniques may be used to minimize reflections at the stubs, physical and electrical constraints severely limit the effectiveness of such solutions at high data rates.

BRIEF DESCRIPTION OF THE DRAWINGS

A better understanding of the present invention can be obtained from the following detailed description in conjunction with the following drawings, in which.

DETAILED DESCRIPTION

In the following description, for purposes of explanation, numerous details are set forth in order to provide a thorough understanding of embodiments of the present invention. However, it will be apparent to one skilled in the art that these specific details are not required in order to practice the present invention as hereinafter claimed.

Embodiments of the present invention concern high speed signaling using parallel plate mode in a computer system. Although the following discussion centers on multi-drop buses, it will be understood by those skilled in the art that the present invention as hereinafter described and claimed may be practiced in support of any type of high speed interconnection on a printed circuit board (PCB), multi-chip module (MCM) or other platform utilizing components which are interconnected on a multi-layer medium.

Figure 1:
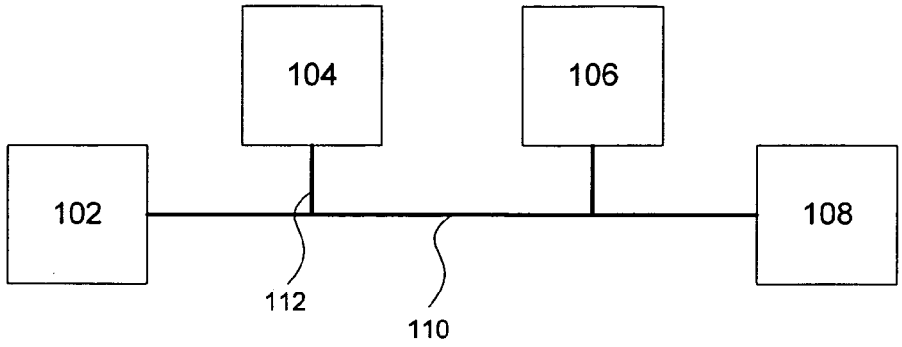
Fig. 1 (Prior Art)
FIG. 1 is an illustration of a multi-drop bus of the prior art.
Figure 2:
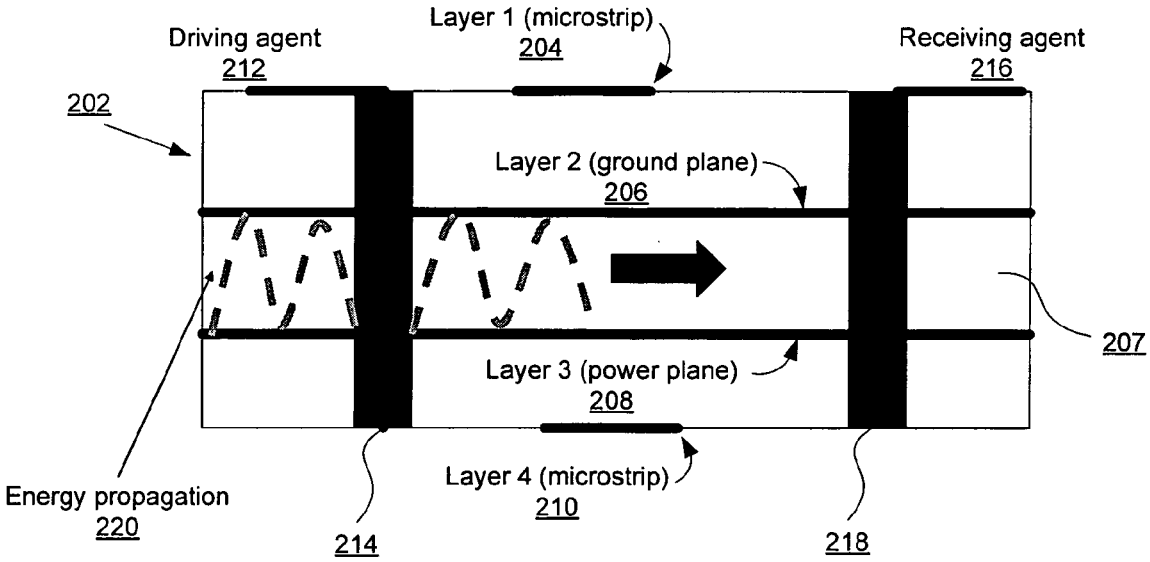
FIG. 2 is an illustration of a cross-sectional view of parallel plate mode on a printed circuit board.

FIG. 2 illustrates a cross-sectional view of an implementation of parallel plate mode on a printed circuit board according to one embodiment. Board (202) may be a multilayer printed circuit board (PCB), multi-chip module (MCM), or other multilayer board.

In one embodiment, the board (202) may have 4 layers, each layer being substantially parallel to one another. On a four layer board, the layers may include two microstrip layers, Layer 1 (204) and Layer 4 (210), used for routing electrical signal traces. The layers may also include a ground plane, Layer 2 (206), and a power plane, Layer 3 (208). Typically these layers of the board are comprised of a conductive material, such as copper or another material suitable for transmitting electrical signals. The conductive layers of the board may be separated by another material (207), typically an insulating material including but not limited to FR4, Teflon, ceramic, polyimide, LCP (Liquid Crystal Polymer), or other materials suitable for electromagnetic wave propagation.

In other embodiments, the board may contain fewer than four conductive layers or more than four conductive layers, and may include multiple signal layers, ground layers, and/or power layers. The layers need not be ordered in any particular way.

The driving agent (212) may be electrically coupled to a driving antenna (214). The receiving agent (216) may be electrically coupled to a receiving antenna. In one embodiment, both the driving antenna and the receiving antenna may be via structures designed to act as "on-board" antennas for both data transmission and reception. The via structure may pass through all layers of the board, or may only pass through some of the layers. In other embodiments, the antennas may be implemented in a different manner.

Energy (220) is transmitted from the driving antenna using parallel plate mode. Parallel plate mode propagates energy by establishing electromagnetic fields between two parallel planes on different layers of a board, such as layers 2 & 3 (206, 208) of the PCB or MCM (202). These electromagnetic fields propagate energy outward from the source (e.g. the driving antenna) in a radial pattern similar to a dipole antenna in free space. The electromagnetic wave propagation is established between two parallel layers of the board, and thus is completely contained within the board.

Parallel plate mode may be used in embodiments of the present invention for data transmission and reception between on-board antennas, such as the via antennas (214, 218) illustrated in FIG. 2. In one embodiment, the driving agent (212) modulates a digital signal on a carrier wave to be transmitted by the driving antenna (214), which may be a via. The driving antenna (214) may then transmit the modulated signal as energy in the form of electromagnetic fields (220) between two conductive layers of the board (206, 208) using parallel plate mode. The energy is then received by the receiving antenna (218) and demodulated at the receiving agent (216) to obtain a digital signal. Thus, the driving antenna (214) may be electromagnetically coupled between two parallel plates (206, 208) to the receiving antenna (218) in parallel plate mode to transmit digital data.

Figure 3:
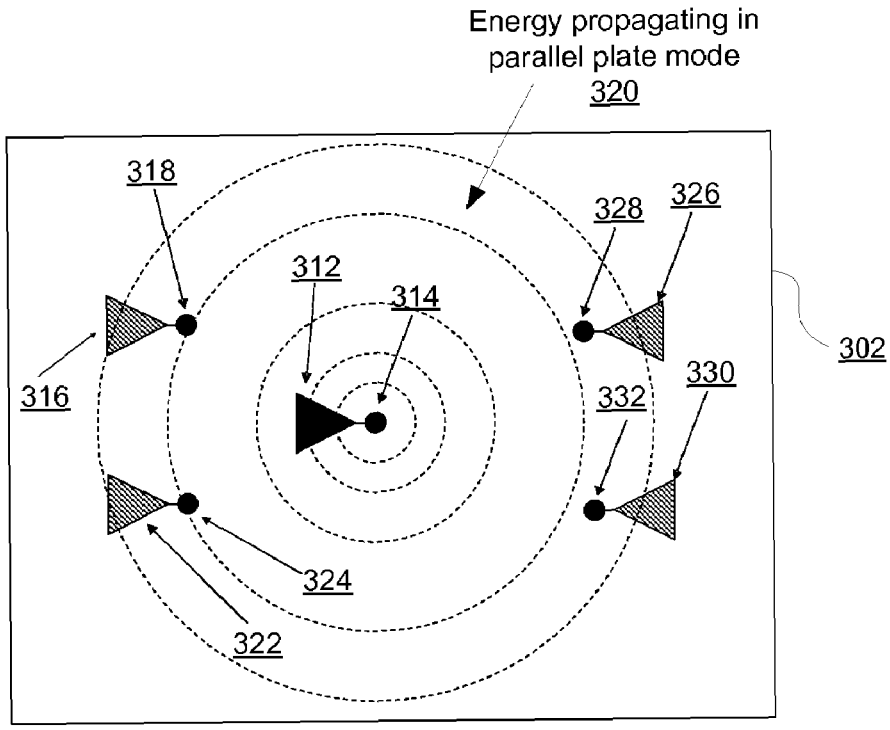
FIG. 3 is an illustration of an overhead view of one embodiment of a parallel plate mode bus.

FIG. 3 illustrates an embodiment of a system implementing a multi-drop bus using parallel plate mode. At least one driving agent (312) and a plurality of receiving agents (316, 322, 326, 330) are on a board (302), which may be a PCB or MCM. The driving agent (312) may be, but is not limited to, a microprocessor, a memory controller device, an I/O controller hub, a memory device, an I/O device, or any other device that is connected to a high speed interconnect. Similarly, the receiving agent (316, 322, 326, 330) may be any device that is connected to a high speed interconnect, including but not limited to, a microprocessor, a memory controller device, an I/O controller hub, a memory device, an I/O device, or any other device. Examples of high speed interconnects may include, but are not limited to, a memory bus or a front side bus. The interconnect may be a multi-drop interconnect as illustrated, connecting multiple devices to the same bus, or may be a point to point interconnect having only one driving agent and one receiving agent.

The board may also include other devices commonly found on printed circuit boards, such as a power source and other electronic components not illustrated here for ease of understanding.

The driving agent (312) is coupled to a driving antenna (314), which may be a via. Each receiving agent (316, 322, 326, 330) is coupled to a receiving antenna (318, 324, 328, 332), which may be a via. When a signal is sent by the driving agent, the driving antenna propagates energy in a radial pattern using parallel plate mode (320). The propagated energy (320) is received at each of the receiving agents (316). As illustrated, the propagated energy (320) may be confined to the board (302) in some embodiments.

In one embodiment, the receiving agents may be different distances from the driving agent (312), such as, for example, receiving agents 322 and 330. In another embodiment, the receiving agents may be approximately equidistant from the driving agent (312), such as, for example, receiving agents 322 and 316.

In one embodiment, a system may include multiple driving agents (312), each driving agent (312) associated with one or more receiving agents (e.g., 316, 322, 326, 330). In a system having multiple driving agents, each driving agent (312) may modulate a digital signal on a different carrier frequency or may be separated from the other signals in some other manner such as phase delay or data encoding mechanisms.

Using parallel plate mode signaling for a multi-drop bus in this manner eliminates bus traces and stubs on the board, because signal lines do not need to be routed for the bus. The electromagnetic field may propagate radially on an entire layer between two conductive or signaling layers on a board, and does not require traces or signal lines. Thus, signal integrity issues and PCB design problems for high speed multi-drop buses are greatly reduced. Multi-drop buses using parallel plate mode may be designed for very high speeds, for example, speeds greater than 1 gigabit per second.

Because the high speed interconnect does not require an electrically routed connection between the driving agent and the receiving agent, in one embodiment, the driving agent and receiving agent may not be electrically coupled to one another via a high speed bus. However, they may be electrically coupled via a power plane, ground plane, or other low speed electrically routed signal(s). In a system such as that illustrated in FIG. 3, when power is applied, the driving antenna and the receiving antenna are capable of being electromagnetically coupled using parallel plate mode.

Figure 4:
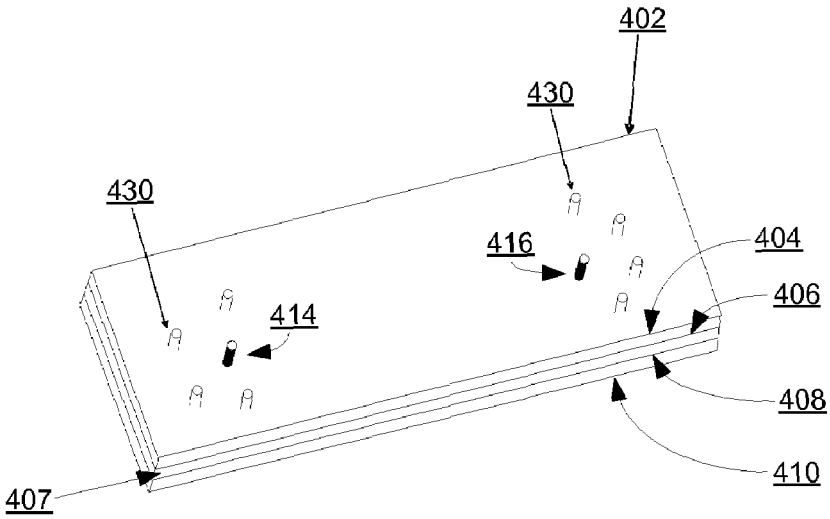
FIG. 4 is an illustration of a structure simulated to demonstrate the feasibility of parallel plate mode signaling.

FIG. 4 is an illustration of a structure simulated to demonstrate the feasibility of parallel plate mode signaling. This structure was simulated in HFSS (High Frequency Structure Simulator), a 3-dimensional electrometric field simulator. Although this example does not illustrate a multi-drop topology, it demonstrates that parallel plate mode is practical for the implementation of high speed buses, whether point-to-point or multi-drop.

A system including a driving via (414) and receiving via (416) on a board (402) having four layers (404, 406, 408, 410) was simulated. The system also included ground vias (430) arranged around the driving and receiving vias to provide directivity to the energy signal. This allows each antenna to act like a parabolic antenna to direct the energy on an inner layer between two parallel planes (407) in the appropriate direction. The use of ground vias is also a technique that may be used to protect certain areas of the board from the parallel plate mode signal. In another embodiment, stitching capacitors may be used to direct the energy signal and/or to protect areas of the board.

Figure 5:
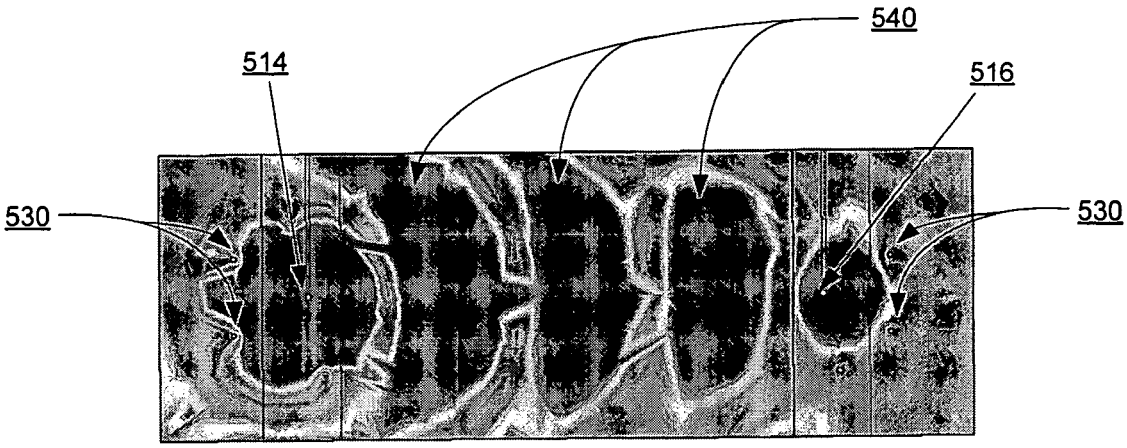
FIG. 5 is an illustration showing the results of a simulation of parallel plate mode signaling.

FIG. 5 illustrates a field plot of the results of the HFSS simulation of parallel plate mode signaling for the structure of FIG. 4. Energy (540) is transferred from the driving via (514) to the receiving via (516). Concentric rings of energy (540) propagate from the driver in a manner similar to the manner in which energy propagates from a dipole antenna. The energy is directed from the driving via to the receiving via by the use of ground vias (530), as described above in conjunction with FIG. 4.

The energy may be confined to the board by the use of stitching capacitors at the edges of the board. This may prevent energy from propagating into free space.

In the example illustrated, the distance between the driving and receiving via antennas is 1 inch. This distance was used for simulation purposes only. This methodology is useful for larger or smaller distances as well.

Figure 6:
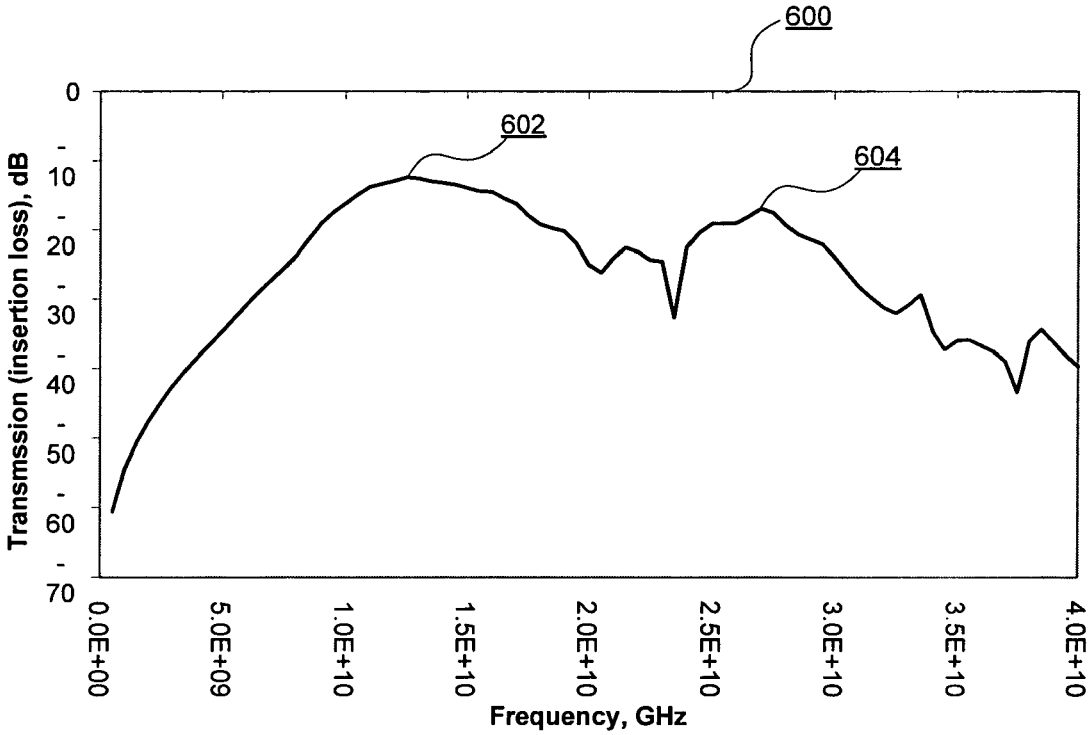
FIG. 6 is a graph illustrating energy transmission from driving to receiving via.

FIG. 6 is a graph (600) illustrating the simulated energy transfer ratio from the driving to the receiving via. The peaks at 13 GHz (602) and 26 GHz (604) are good candidates for carrier frequencies to transmit modulated digital data. Although the vias as simulated are one inch apart, the energy transfer from driving agent to receiver is as high as 25%, which is more than adequate for reliable data transmission at very high speeds.

Figure 7:
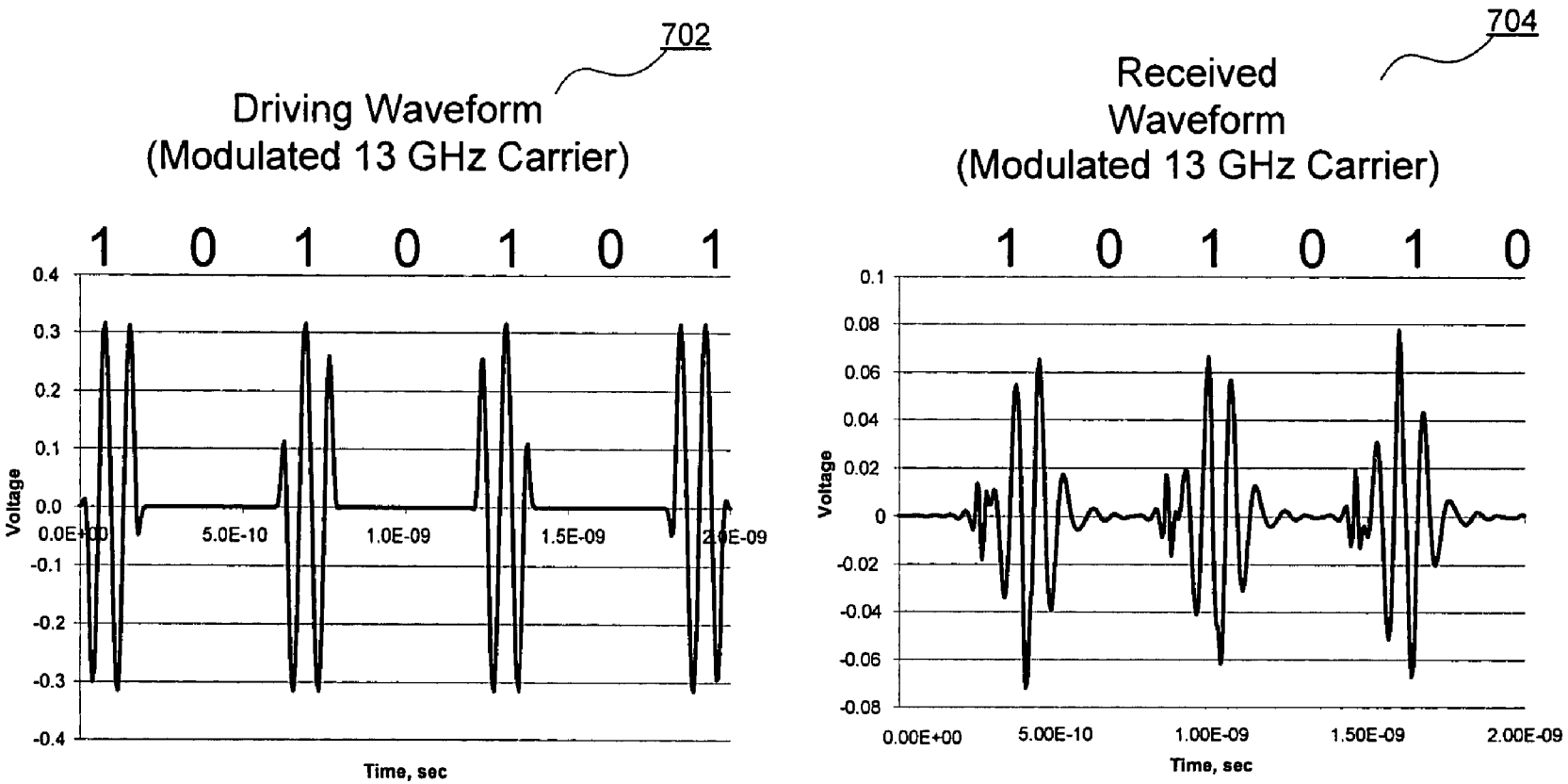
FIG. 7 is an illustration of a waveform transmitted and received using parallel plate mode signaling.

FIG. 7 illustrates an example of data transmitted (702) and received (704) via parallel plate mode at 3.5 gigabits per second using a modulated carrier of 13 GHz. These waveforms were produced in an HFSS simulation of the structure of FIG. 4. In one embodiment, the frequency of the carrier wave may be a value chosen to correspond to the peak of the insertion loss (e.g., 13 GHz), as illustrated in the graph of FIG. 6. The modulation of the carrier in this example was achieved using a switch that was open for a digital high state and closed for a digital low state, however, other modulation techniques may be used as well.

Although this example was not optimized, it is possible to design a system utilizing parallel plate mode data transfer optimized for very high data rates.

Thus, a method, apparatus, and system for transmitting and receiving data signals using parallel plate mode are disclosed. In the above description, numerous specific details are set forth. However, it is understood that embodiments may be practiced without these specific details. In other instances, well-known circuits, structures, and techniques have not been shown in detail in order not to obscure the understanding of this description. Embodiments have been described with reference to specific exemplary embodiments thereof. It will, however, be evident to persons having the benefit of this disclosure that various modifications and changes may be made to these embodiments without departing from the broader spirit and scope of the embodiments described herein. The specification and drawings are, accordingly, to be regarded in an illustrative rather than a restrictive sense.

We claim:

1. An apparatus comprising:

a driving agent electrically coupled to a driving antenna; and a first receiving agent electrically coupled to a first receiving antenna, wherein the driving antenna is electromagnetically coupled between two parallel plates to the first receiving antenna, wherein the driving antenna propagates energy in a radial pattern, and wherein the two parallel plates are interior layers of a printed circuit board.

2. The apparatus of claim 1, wherein the driving antenna is a via and the first receiving antenna is a via.

3. The apparatus of claim 1, wherein the two parallel plates are conductive layers.

4. The apparatus of claim 3, wherein the two parallel plates are a ground plane and a power plane.

5. The apparatus of claim 1, wherein the ground plane and the power plane are separated by a material selected from the group consisting of FR4, ceramic, polyimide, and LCP.

6. The apparatus of claim 1, further comprising a second receiving agent electrically coupled to a second receiving antenna, wherein the driving antenna is electromagnetically coupled between two parallel plates to the second receiving antenna.

7. The apparatus of claim 6, wherein the first receiving agent and the second receiving agent are each a different distance from the driving agent.

8. The apparatus of claim 6, wherein the first receiving agent and the second receiving agent are equidistant from the driving agent.

9. A method comprising:

transmitting a modulated signal from a driving antenna to a receiving antenna on a printed circuit board in a radial pattern using parallel plate mode; and modulating a digital signal on a carrier wave by opening a switch for a digital high state and closing the switch for a digital low state.

10. The method of claim 9, further comprising demodulating the modulated signal to obtain a digital signal at a receiving agent.

11. The method of claim 10, wherein parallel plate mode propagates energy by establishing an electromagnetic field between two planes on different layers of the printed circuit board.

12. The method of claim 11, further comprising confining the modulated signal to the printed circuit board.

13. The method of claim 10, wherein the carrier wave has a frequency which is selected to correspond to a peak insertion loss value.

14. The method of claim 9, wherein the driving antenna and the receiving antenna are vias.

15. A system comprising:

a driving agent coupled to a driving antenna; and a plurality of receiving agents, each of the plurality of receiving agents coupled to one of a plurality of receiving antennas, wherein the driving antenna is capable of being electromagnetically coupled in parallel plate mode to each of the plurality of receiving antennas when power is applied to the system, wherein the driving antenna is capable of propagating energy in a radial pattern, and wherein the driving agent, the driving antenna, the plurality of receiving agents, and the plurality of receiving antennas are on a multi-layer printed circuit board.

16. The system of claim 15, wherein the driving agent is a memory controller device.

17. The system of claim 16, wherein each of the plurality of receiving agents is a microprocessor.

18. The system of claim 15, wherein the driving antenna is a via and each of the plurality of receiving antennas is a via.

* * * * *